US006169477B1

(12) United States Patent
Fiato

(10) Patent No.: US 6,169,477 B1
(45) Date of Patent: Jan. 2, 2001

(54) COMBINED STORAGE AND SAFETY DEVICE

(76) Inventor: Marco Fiato, 215 Caravan Dr., Birdsboro, PA (US) 19508

( * ) Notice: Under 35 U.S.C. 154(b), the term of this patent shall be extended for 0 days.

(21) Appl. No.: 09/208,952

(22) Filed: Dec. 9, 1998

(51) Int. Cl.[7] ..... G08B 27/00

(52) U.S. Cl. ..... 340/326; 340/332; 340/539; 340/573.1; 166/63 P

(58) Field of Search ..... 40/612, 540, 798; 116/63 P; 340/326, 321, 332, 539, 573.1, 572.1, 825.36, 825.49

(56) References Cited

U.S. PATENT DOCUMENTS

| | | | | |
|---|---|---|---|---|
| 2,002,248 | * | 5/1935 | Muehleisen | 340/326 |
| 2,669,705 | | 2/1954 | Collins | 340/114 |
| 3,886,519 | * | 5/1975 | Hovland | 340/326 |
| 4,713,910 | | 12/1987 | Quante | 49/49 |
| 4,777,751 | | 10/1988 | Pasquale | 40/612 |
| 4,847,589 | | 7/1989 | Dobbins | 340/326 |
| 5,328,066 | * | 7/1994 | Cappuccio et al. | 224/42.03 |
| 5,729,215 | | 3/1998 | Jutras | 340/908.1 |

* cited by examiner

*Primary Examiner*—Daryl Pope
(74) *Attorney, Agent, or Firm*—Henderson & Sturm LLP

(57) ABSTRACT

A combined storage and safety device 10 to warn drivers of the presence of children in the vicinity of the device 10. The device 10 includes a storage compartment member 20 provided with a wheel assembly 30 and hingedly connected to a folding panel arrangement 40 that depicts the upper torso and head of a policeman in uniform. A plurality of signaling units 13 including printed signs 50, a flashing light 52, and an audible alarm member 54 are operatively associated with the storage compartment 20 and the folding panel arrangement 40.

11 Claims, 2 Drawing Sheets

COMBINED STORAGE AND SAFETY DEVICE

BACKGROUND OF THE INVENTION

1. Field of the Invention

The present invention relates to the field of safety signaling devices in general, and in particular to a combined child's toy storage cart provided with an illuminated signaling means.

2. Description of Related Art

As can be seen by reference to the following U.S. Pat. Nos., 2,669,705; 4,713,910; 4,777,751; 4,847,589; and 5,729,215, the prior art is replete with myriad and diverse illuminated safety signaling devices.

While all of the aforementioned prior art constructions are more than adequate for the basic purpose and function for which they have been specifically designed, they are uniformly deficient with respect to their failure to provide a simple, efficient, and practical device that can be used by parents to alert drivers that children are playing in an area and which also provides a wheeled storage compartment to store the children's playthings.

As most parents are all too well aware, their greatest fear when their children are playing outside is that an inattentive driver will not notice the presence of small children playing in the area, and as a consequence strike one of the children with their vehicle.

As a consequence of the foregoing situation, there has existed a longstanding need among parents for a new and improved combined safety and storage device that will both alert drivers to the presence of children, as well as serve as a convenient wheeled storage receptacle for the children's toys and playthings, and the provision of such a construction is a stated objective of the present invention.

BRIEF SUMMARY OF THE INVENTION

Briefly stated, the combined storage and safety device that forms the basis of the present invention comprises in general, a wheeled storage unit, a plurality of signal support units operatively associated with the storage unit, and a plurality of signaling units associated with both the signal support units and the storage unit.

As will be explained in greater detail further on in the specification, the plurality of signal support units are operatively associated with the wheeled storage unit and include a folding panel unit configured to resemble a police officer and dimensioned to be received in the upper portion of the wheeled storage unit and a plurality of holder elements mounted on the wheeled storage unit and the folding panel arrangement.

In addition, the plurality of signal units include a pair of printed sign members removably attached to the folding panel arrangement, a flashing light member associated with the exterior of the wheeled storage unit, and an audible alarm member mounted within the wheeled storage unit and capable of being actuated both at the wheeled storage unit and at a remote location relative to the wheeled storage unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
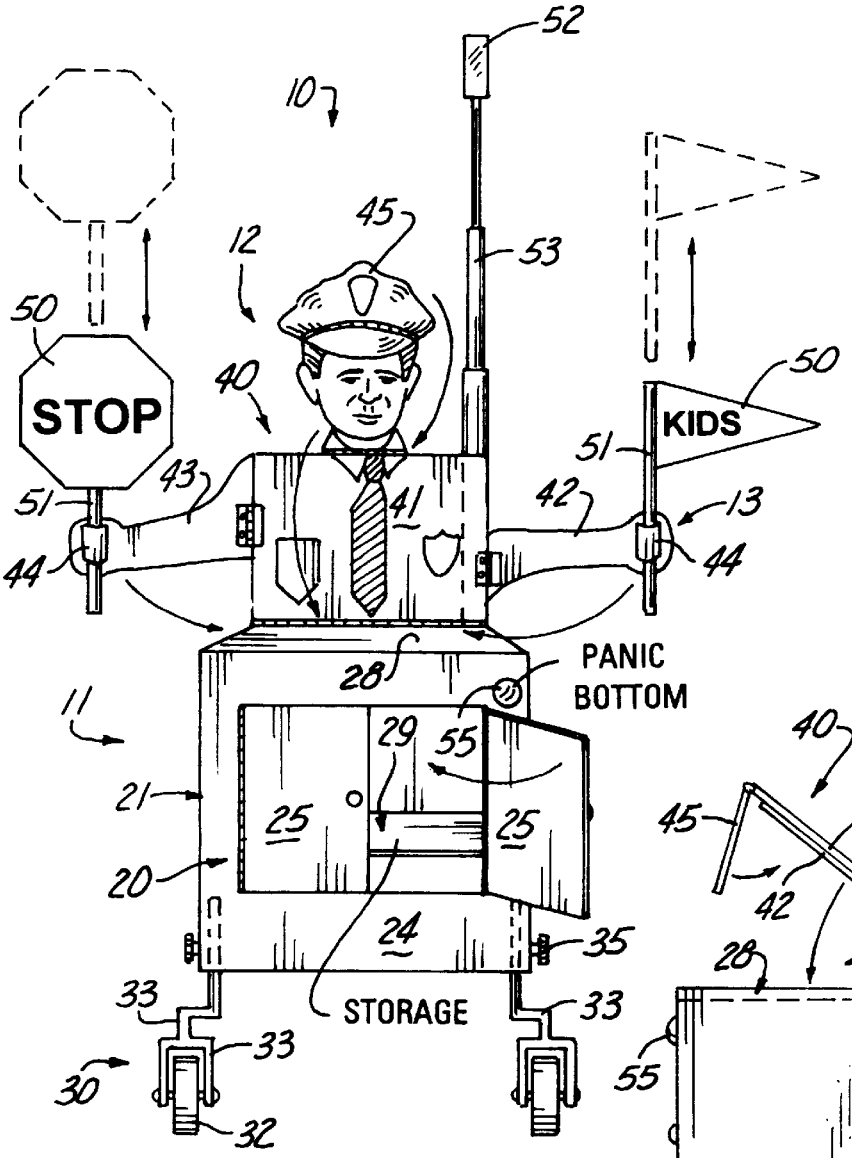
FIG. 1 is a front elevational view of the combined storage and safety device that forms the basis of the present invention.

As can be seen by reference to the drawings, and in particularly to FIG. 1, the combined storage and safety device that forms the basis of the present invention is designated generally by the reference number 10. The device 10 comprises in general, a wheeled storage unit 11, a plurality of signal support units 12, and a plurality of signal units 13. These units will now be described in seriatim fashion.

Figure 2:
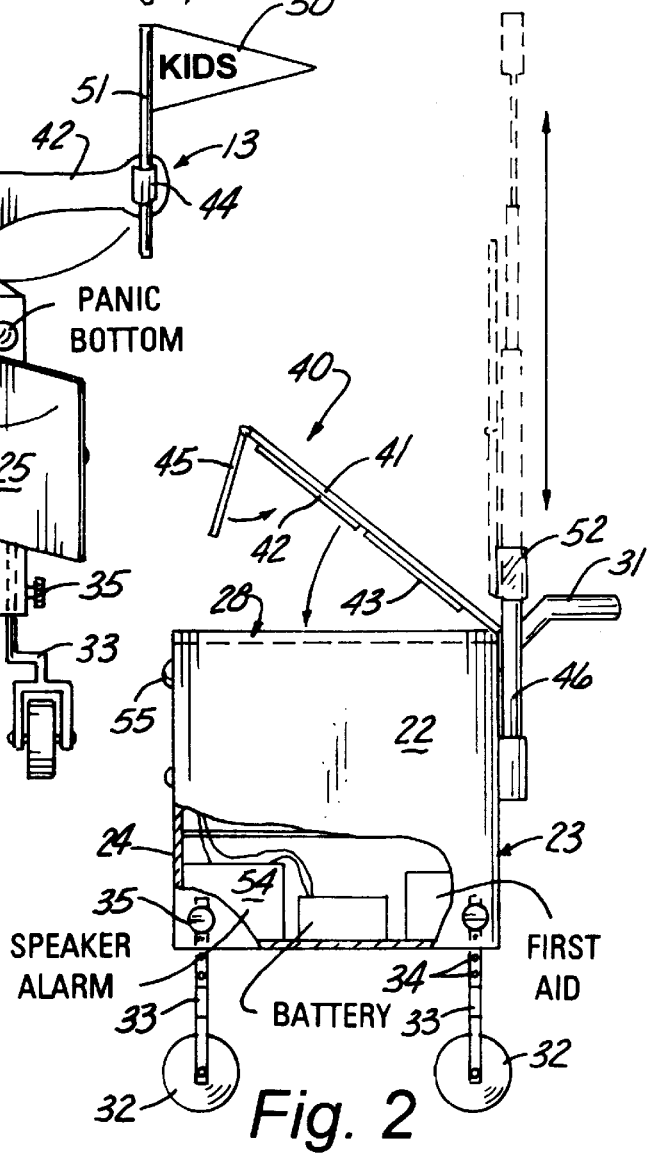
FIG. 2 is a side elevational view of the combined storage and safety device.

As shown in FIGS. 1 and 2, the wheeled storage unit 11 comprises in general, an enlarged generally rectangular storage compartment member 20 having a pair of sidewalls 21, 22, a rear wall 23, a front wall 24 provided with a pair of doors 25, a floor panel 26, an open top 27, an upper shelf element 28 disposed proximate to the open top 27 and at least one additional interior shelf element 29 disposed within the interior of the storage compartment member 20.

Figure 4:
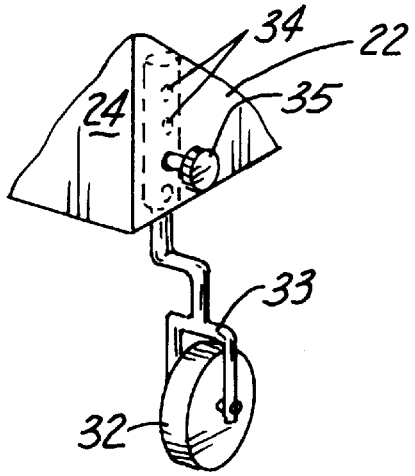
FIG. 4 is an isolated detail view of the adjustable wheel height mechanism.

In addition, as shown in FIGS. 1, 2, and 4, the storage compartment member 20 is further provided with a wheel assembly designated generally as 30 and a handle element, 31 which projects outwardly from the rear wall 23.

The wheel assembly 30 comprises four wheel members 32 wherein each wheel member 32 is provided with an elongated axle yoke 33 provided with a plurality of apertures 34. The axle yoke 33 is dimensioned to be received through apertures in the floor panel 26 and the apertures 34 are dimensioned to receive a locking pin 35 that extends through a suitably dimensioned aperture in the sidewalls 21, 22 to vary the effective height of the wheel assembly 30 in a well recognized fashion.

Figure 3:
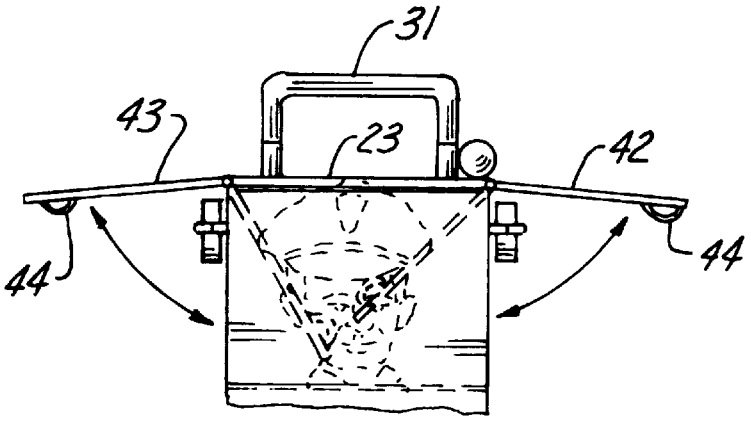
FIG. 3 is a top plan view of the collapsible policeman panel.

As shown in FIGS. 1 through 3, the plurality of signal support units 12 comprise a first collapsible panel arrangement configured in the shape of a policeman and designated generally as 40. The collapsible panel arrangement 40 includes an enlarged generally rectangular upper torso panel 41 hingedly connected on its lower end of the top of the rear compartment panel 23, a pair of vertically offset right and left arm panels 42, 43 hingedly connected to the opposite sides of the torso panel 41. The outboard ends of each arm panel 42, 43 are provided with open ended cylindrical holder elements 44 and ahead panel 45 hingedly connected to the upper portion of the torso panel 41. The appropriate portions of the hinged panel arrangement are painted or otherwise colored to represent the upper portion of a police officer in uniform.

In addition, the plurality of signal support units further comprise a second closed bottom cylindrical holder element 46 which is mounted on the upper portion of the rear panel 23 of the compartment member 20. The purpose and function of the cylindrical holder elements 44 and 46 will be described presently.

Returning once more to FIGS. 1 and 2, it can be seen that the plurality of signaling units 13 comprise in general, a pair of printed signal members 50 mounted on staffs 51 that are dimensioned to be received on the arm mounted cylindrical holder element 44 and a flashing light member 52 mounted on a telescopic stem 53 that is dimensioned to be received in the cylindrical holder element 46 disposed on the rear panel 23 of the compartment member.

Figure 5:
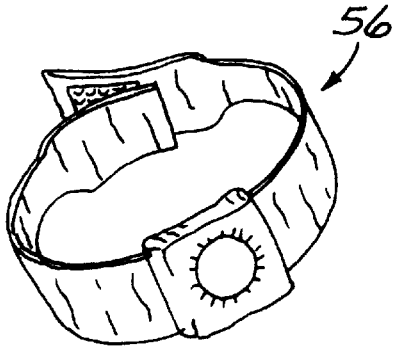
FIG. 5 is an isolated detail view of the proximity alert wrist band that is intended for use with this device.

In addition, as shown in FIGS. 2 and 5, the plurality of signaling units further comprises an audible alarm member 54 operatively connected to a panic button 55 that can be activated by a child if a stranger approaches and which likewise will be activated if a child wearing a wrist transmitter 56 wanders a predetermined distance away from the audible alarm member 54.

At this juncture, it should also be noted as shown in FIG. 2, that the folding panel arrangement 40 is designed and dimensioned to be received with the upper portion of the storage compartment member 20 and to rest upon the upper shelf element 28.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A combined storage and safety device for the protection of small children wherein the device comprises:

a wheeled storage unit including a storage compartment member provided with a wheel assembly;

a plurality of signal support units operatively associated with the storage compartment member and including a plurality of holder elements; wherein said plurality of signal support units further comprises a folding panel arrangement hingedly connected to the top of the storage compartment member and wherein said folding panel arrangement resembles the upper torso and head of a policeman in uniform; and a plurality of signaling units operatively associated with both the wheeled storage unit and the plurality of signal support units, wherein the plurality of signaling units further include an audible alarm member disposed within said storage compartment member and adjusted to be activated by a panic button mounted on the storage compartment member; and further adapted to be remotely activated by a transmitter worn by a child located in the vicinity of the audible alarm member.

2. The device as in claim 1 wherein the plurality of signaling units include a light member and a printed sign member mounted on a staff that is adapted to be releasably received in one of said plurality of holder elements.

3. The device as in claim 2 wherein said light member is a flashing light member.

4. The device as in claim 3 wherein said light member is mounted on a telescoping stem that is dimensioned to be received in another of said plurality of holder elements.

5. The device as in claim 1 wherein one of said plurality of holder elements is mounted on said folding panel arrangement.

6. The device as in claim 5 wherein another of said plurality of holder elements is mounted on said storage compartment member.

7. The device as in claim 1 wherein said folding panel arrangement comprises:

an upper torso panel hingedly connected to the top of the storage compartment member and a head panel hingedly connected to the top of the upper torso panel.

8. The device as in claim 7 further including a pair of arm panels mounted on opposite sides of the upper torso panel.

9. The device as in claim 8 wherein said arm panels are vertically offset from one another.

10. The device as in claim 1 wherein said folding panel arrangement is dimensioned to be received in the upper portion of the storage compartment member.

11. The device as in claim 8 wherein at last one of the holder elements are mounted on the outer end of at least one of the arm panels.

* * * * *